US005918738A

United States Patent [19]

Leistner

[11] Patent Number: 5,918,738

[45] Date of Patent: Jul. 6, 1999

[54] TEE-NUT STRIP WITH EDGE MEMBRANES

[75] Inventor: Martin Leistner, Toronto, Canada

[73] Assignee: Sigma Tool & Machine, Scarborough, Canada

[21] Appl. No.: 09/190,621

[22] Filed: Nov. 12, 1998

[51] Int. Cl.[6] ..... B65D 85/24

[52] U.S. Cl. ..... 206/344; 206/346; 53/443

[58] Field of Search ..... 53/443, 448, 176, 53/410; 206/338, 340, 341, 343, 344, 345, 346

[56] References Cited

U.S. PATENT DOCUMENTS 3,967,727 7/1976 Jakesch ..... 206/344

4,955,476 9/1990 Nakata et al. ..... 206/346

5,762,190 6/1998 Leistner ..... 206/345 X

*Primary Examiner*—Jacob K. Ackun

[57] ABSTRACT

A Tee-nut strip having Tee-nuts with generally cylindrical internally threaded sleeves, and flanges formed around one end of the sleeves, and a membrane or membranes formed of flexible material, adhesive bonding a membrane to first sides of the flanges, with the Tee-nuts in sequential closely spaced relation along the membrane and, portions of a membrane bonded to second sides of the flanges, so that the membranes portions grip the flanges on both first and second side surfaces simultaneously, and a method of forming a Tee-nut strip with upper and under membranes gripping the flanges on both sides.

21 Claims, 6 Drawing Sheets

TEE-NUT STRIP WITH EDGE MEMBRANES

FIELD OF THE INVENTION

The invention relates to fasteners known as Tee-nuts, which are formed into a strip by means of a flexible membrane secured to the Tee-nuts.

BACKGROUND OF THE INVENTION

Tee-nut fastening devices are widely used in many industries, in particular in the furniture industry. They consist of a sheet metal member having a sleeve with internal threads, and flanges around one end of the sleeve and spikes formed at right angles to the flanges which are embedded in the workpiece around a pre-drilled hole.

They are widely used for constructing furniture items such as bookshelves, cupboards, chairs, beds and the like, and in many other situations. Various forms of high-speed insertion machines have been devised, by means of which the Tee-nuts may be driven into a workpiece. Usually there is a pre-drilled hole in which the sleeve is received, and the flange lies on the surface of the workpiece with the spikes embedded in it, thereby holding the entire Tee-nut in position. Modified forms of Tee-nuts are available which are flared out at the free ends of the sleeves so as to provide a more secure hold in the workpiece. Other forms of Tee-nuts are available which are formed with sleeves capable of punching their own hole through the workpiece.

The rapidity and repetition rate of the insertion of such Tee-nuts into a workpiece is a significant cost factor in the production of the end product. In the past, insertion machines have been provided with hoppers. The Tee-nuts were simply dumped loose in the hopper, and the hopper vibrated, to separate the Tee-nuts and cause them to enter a feedslide. The feedslide supplied the Tee-nuts, one after another, to the punch.

These systems were not always reliable and in some cases the hoppers became jammed with Tee-nuts and in other cases the feedslide became jammed because the Tee-nuts would not slide down the feedslide.

Various examples of such Tee-nut setting machines are shown, one example being shown for example in U.S. Pat. No. 3,460,217. A modified form of Tee-nut machine in which the Tee-nuts were driven upwardly into the workpiece is shown in U.S. Pat. No. 4,821,940. The problem with these systems involving loose Tee-nuts is that the slide would feed the Tee-nuts to a feed mechanism which would then deliver them one at a time to a plunger or punch. This was relatively complex and costly, and was not always reliable, at the speeds of operation which are required.

With a view to overcoming many of these disadvantages and with a view to providing a much simpler machine, a Tee-nut inserting machine was devised, for receiving Tee-nuts from a coil or roll. The Tee-nuts themselves were formed into a coil by means of a backing tape or membrane, or in some cases by means of welded wire filaments. Examples of such systems are shown in U.S. Pat. Nos. 4,214,843; 5,327,645; 5,299,686 and 5,214,843.

The machines and Tee-nut strips disclosed in these patents overcame the problems arising from placing loose Tee-nuts in a hopper, and then attempting to sort out the Tee-nuts and feed them one by one down a Tee-nut slide.

However, the formation of the Tee-nuts into a strip by means of a flexible membrane such as a tape was not always totally satisfactory. In some cases, the membrane, which might be for example, paper or the like, would simply break between the Tee-nuts. In other cases, the formation of the Tee-nut strips by means of welded wires was not always satisfactory due to the difficulties and complexities of forming high-speed spot welds. In both systems, when the insertion machines were operated at high speed there was a tendency for the Tee-nut strips to become broken or Tee-nuts to become separated from the strip. In both cases this would lead to a false insertion of a Tee-nut, i.e. there would be a hole in the workpiece with no Tee-nut, and this was unacceptable.

The first objective of the invention therefore is to provide an improved fastener strip such as a Tee-nut strip which is capable of high-speed operation with fastener insertion machines, whether of the type described or otherwise.

A further requirement which has developed more recently, is the provision of a portable fastener applicator for example for use with Tee-nuts, similar to the air pressure-operated nailing applicators which are in common use.

A portable hand-held fastener applicator would have many advantages over the stand-alone applicator machines. However, in order to operate, a satisfactory form of fastener strip must be provided for the portable hand-held fastener applicator.

BRIEF SUMMARY OF THE INVENTION

With a view to providing an improved fastener strip, for example a Tee-nut strip, the invention provides a fastener strip in which, said fasteners are of the type having a generally cylindrical internally threaded sleeve, and flanges formed around one end of the sleeve, extending a predetermined width, and the Tee-nut strip comprising membrane means formed of flexible material said membrane means being bonded to first sides of said flanges on said fasteners, with said fasteners in sequential closely spaced relation along said membrane means, and, portions of said membrane means being bonded to second sides of said flanges, whereby said membrane means grips said flanges on both first and second side surfaces simultaneously.

A further feature of the invention is the provision of portions of said membrane means extending between said fasteners, with edge portions of said membrane means being bonded directly to one another between said fasteners to form a double thickness laminate.

A particular form of the invention provides two portions of such membrane means, defining a linear spacing there between along the length of the centre of said fasteners; such as Tee-nuts, with said two portions being spaced on opposite sides of said linear spacing and folding around said flanges of said Tee-nuts as aforesaid. One advantage of this system is that it leaves the central portion of the leading and trailing edge of each Tee-nut clear of obstruction. This improves the ability of the Tee-nut strip to be reliably fed in a typical feed slide mechanism.

The membrane means can also comprise a single membrane extending completely across the upper surface of the fastener having a width greater than the width of the flanges and having edges folded around the underside of the flanges.

The membrane means can be of any suitable material such as paper, or synthetic material such as thermoplastic strip materials and the like, and the adhesive can be any suitable adhesive, the membrane means being tearable between adjacent fasteners as they are inserted into the workpiece. In another embodiment, the membrane means can simply be extruded plastic material which is extruded hot directly onto the upper and under surfaces of the flanges of the fasteners. Combinations of membrane web material, and extruded membrane material may also be used on opposite sides of the flanges in some cases.

The membrane means will be sufficiently flexible that the strip can be rolled into a coil if desired.

In another embodiment the membrane means comprises upper and under strips of membrane material which are separate from one another, and are simply bonded as separate members to the upper and under side of the flanges of the fastener, for example a Tee-nut, without being folded around the edges of the flanges.

A method of forming fasteners, for examples Tee-nuts into a strip using membrane means as described above is also a feature of the invention, and incorporates the steps of bonding the membrane means to the fastener and indenting the membrane means between adjacent fastener whereby to bond the membrane means to form a double thickness laminate.

The invention applicable to forms of fasteners, other than Tee-nuts, having flange portions which can be engaged by a membrane, which can be bonded to both sides of the flange portions and engages the flange portions on opposite surfaces, although Tee-nuts are the principal application of the invention.

The various features of novelty which characterize the invention are pointed out with more particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

IN THE DRAWINGS

DESCRIPTION OF A SPECIFIC EMBODIMENT

Figure 1:
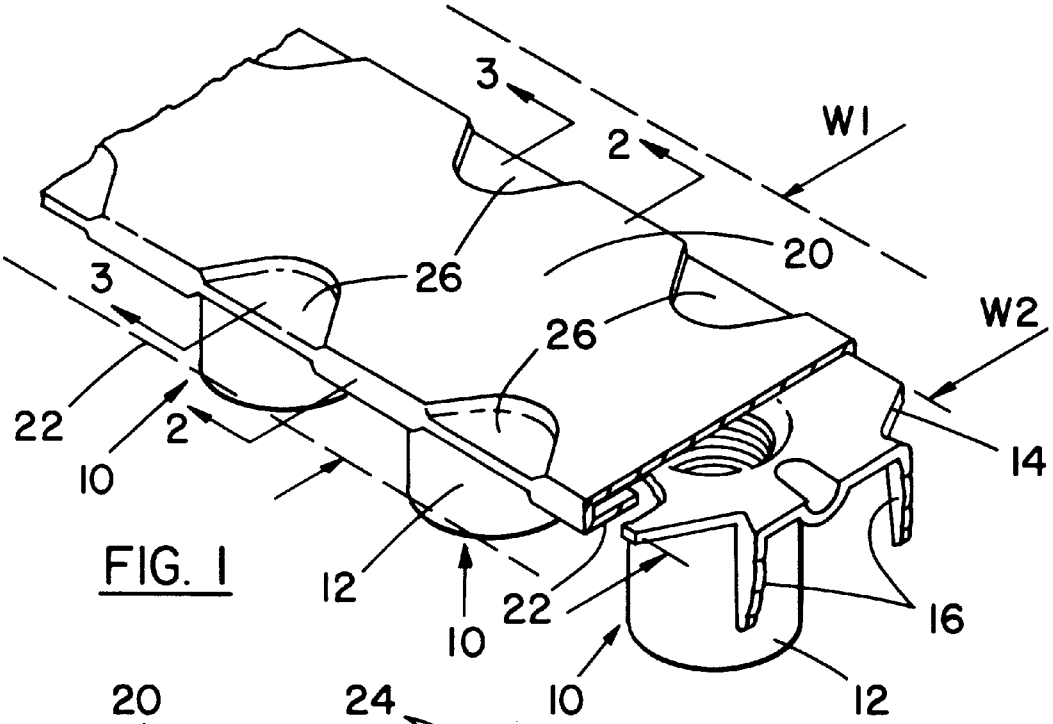
FIG. 1 is an upper perspective illustration partially cut away showing a Tee-nut strip in accordance with a first embodiment of the invention.
Figure 2:
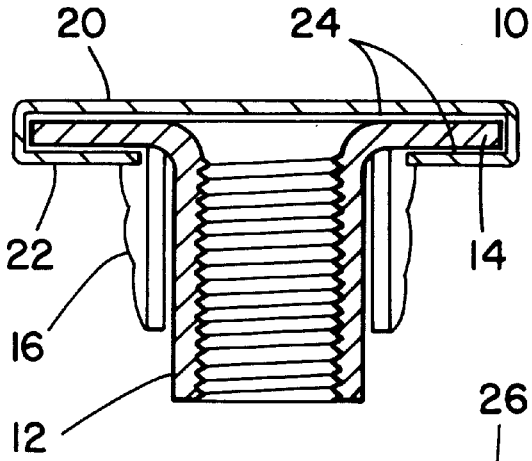
FIG. 2 is a section along the line 2—2 of FIG. 1.
Figure 3:
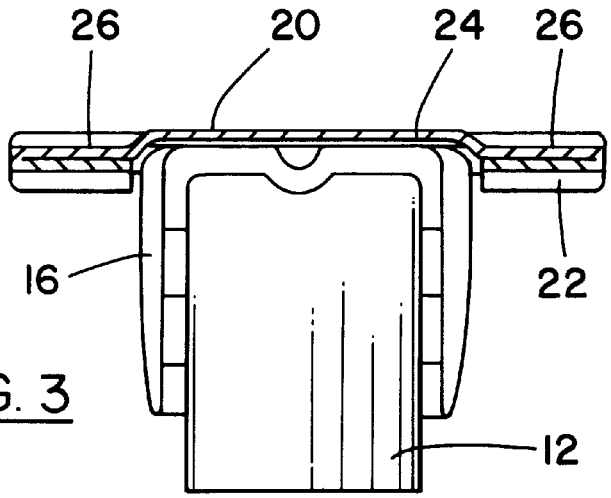
FIG. 3 is a section along the line 3—3 of FIG. 1.

Referring first of all to FIGS. 1, 2 and 3 the Tee-nut strip according to the invention will be seen to be comprised of a plurality of Tee-nuts indicated generally as 10. Each of the Tee-nuts has an internally threaded cylindrical sleeve 12. At the upper end of the sleeves 12 there are formed flanges 14—14. Prongs or spikes 16—16 extend downwardly from the flanges at right angles.

As explained above, the invention is of general application to forming various types of fasteners into a strip, although Tee-nuts are a typical example of fasteners which are suitable for this system and also troublesome to handle in other ways. However, the invention is not restricted solely to the application of Tee-nuts but comprehends all such fasteners as may be formed into a strip in this way. The use of the term "Tee-nuts" throughout is deemed to be generic to all such fasteners.

In order to form the Tee-nuts into a strip, a membrane means is applied to the first or upper surfaces of the flanges 14—14. In this embodiment the membrane means comprises a continuous membrane strip 20, in this case typically being formed of thin flexible thermo-plastic material. The membrane means may also be formed of paper, or paper together with a laminate of thermo-plastic material or adhesive, or may simply be an extruded strip or strips of thermo-plastic material which is(are) extruded directly onto the Tee-nuts. In some cases it may be desirable to use a combination of the above, i.e. extruded membrane material on the upper surface of the flanges, and web material bonded on the under surface of the flanges. In this embodiment the membrane strip 20 has a width W1 indicated by the chain dotted lines in FIG. 1, and the width W1 is greater than the width W2 defined by the edges of the two flanges 14. In this way, the side edges indicated as 22—22 of the membrane 20 overlap on either side of the flanges 14. During fabrication these side edges are folded over the ends of the flanges 14—14 of each nut 10. The membrane 20 is formed typically with an adhesive surface indicated generally as 24 (FIGS. 2 and 3). In this way the main portion of the membrane 20 is adhesively bonded to the upper or first surfaces of the flanges 14, and the folded over edge portions 22—22 are bonded to the underside or second surfaces of the flanges 14—14.

During manufacture, the portions of the membrane 20 and folded edge portions 22 extending between adjacent Tee-nuts 10 will be pinched or squeezed as at 26, so that in this way the upper and under portions of the membrane are bonded together to form a double thickness laminate membrane, which double thickness portion extends between adjacent Tee-nut flanges.

It will be observed that the Tee-nut flanges 14 are of what may be considered as generally octagonal shape, so that their side edges define angular spacings which will permit the squeezing of the membrane portions 26—26 between adjacent flanges 14. This materially increases the strength and usefulness of the Tee-nut strip.

Figure 4:
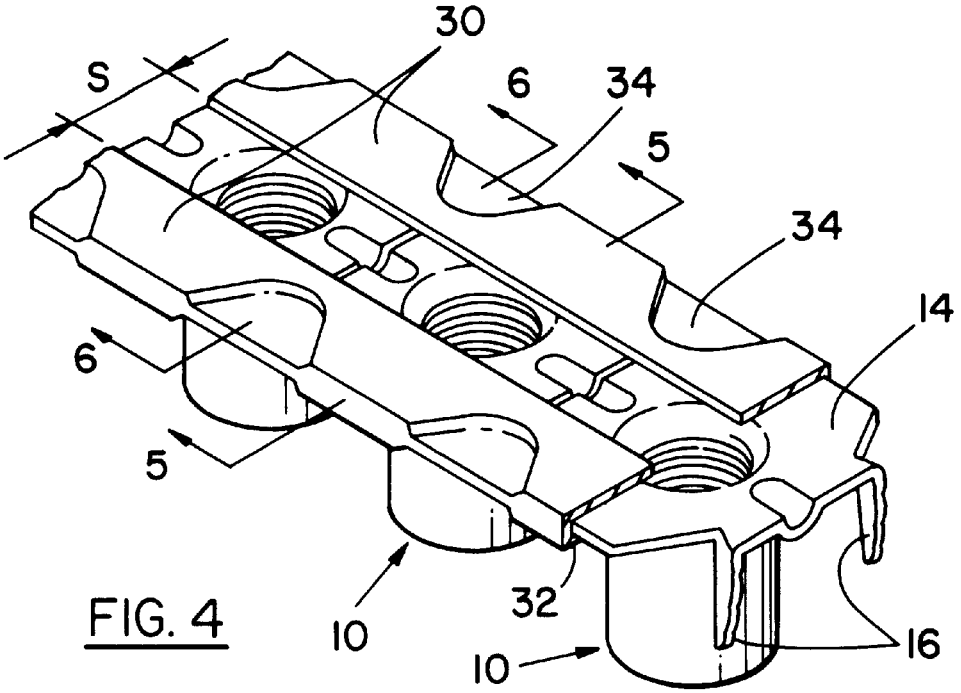
FIG. 4 is an upper perspective illustration partially cut away of another embodiment.
Figure 5:
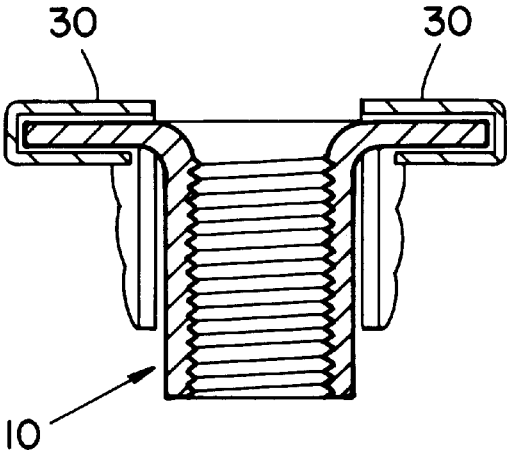
FIG. 5 is a section along the line 5—5 of FIG. 4.
Figure 6:
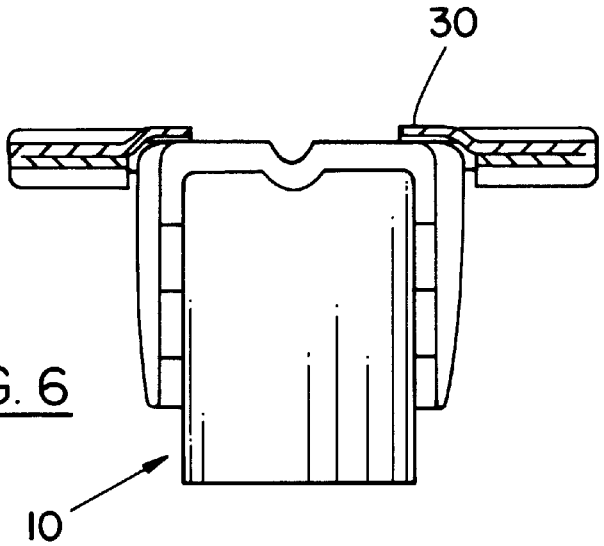
FIG. 6 is a section along the line 6—6 of FIG. 4.

In another embodiment of the invention, as shown in FIGS. 4, 5 and 6, the membrane means may comprise a pair of membrane strips 30—30, which define a spacing S between them. The spacing S will register with the open upper ends of the internally threaded sleeves 12.

As in the case of the FIG. 1 embodiment, the two membrane strips 30—30 will define folded over edge portions 32—32, which are folded under the ends of the flanges 14 of the Tee-nuts. Between the Tee-nut flanges, indented portions 34 are formed, by squeezing the upper and under portions of the membrane strips together to form a double thickness laminate.

Figure 7:
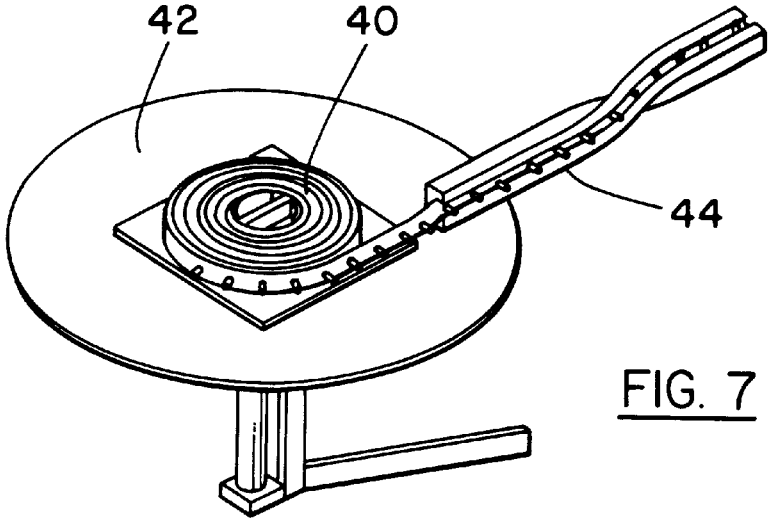
FIG. 7 is a perspective illustration of one form of feed mechanism showing the Tee-nut strip rolled into coil.

As explained, the Tee-nut strips may be used in various ways. For example they may be used simply coiled into a large coil and placed on a feed table as shown in FIG. 7, the coil being shown as 40 and the table being shown as 42. In a typical case the strip as it is uncoiled off the coil 40 may be passed through a feed slide 44 which rotates the strip through a ninety degree rotation so as to place the Tee-nut barrels facing either vertically upwards (as shown) or vertically downwards (not shown) depending upon the design of the insertion machine.

Clearly the Tee-nut strips may also be used in other applications and in particular for example in portable Tee-nut applicators (not shown) which would be similar to power operated nailing applicators. The Tee-nut strip would then simply be fed in through a magazine slide (not shown) such as well known in the art relating to nailing applicators.

Figure 8A:
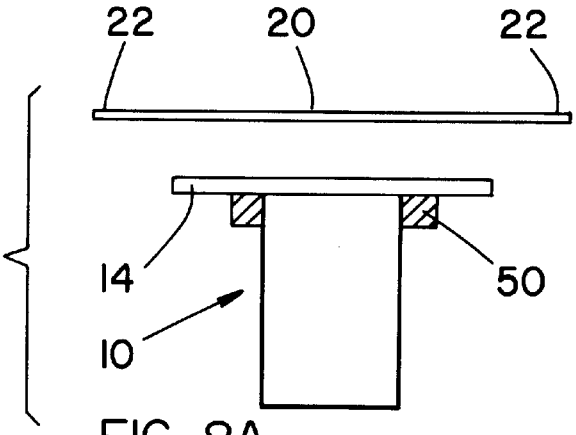
FIGS. 8A, 8B and 8C are schematic illustrations showing the step-wise formation of the Tee-nut strip in accordance with the embodiments of FIGS. 1 or 4.
Figure 8B:
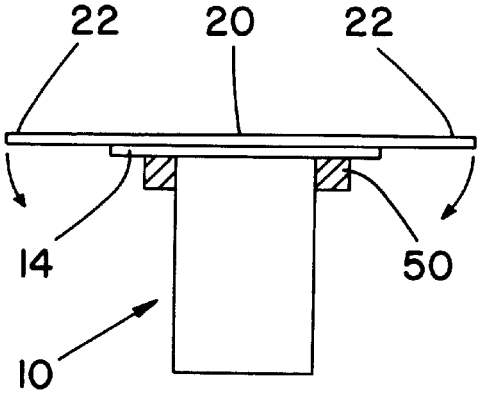
Figure 8C:
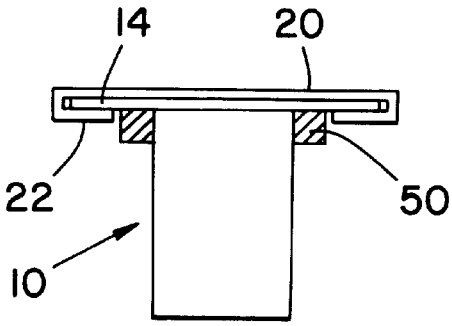

The formation of the strip is believed to be self-evident from the foregoing description, but is illustrated in step-wise form in the schematic drawings of FIGS. 8A, 8B and 8C. In FIG. 8A the Tee-nuts 10 are arranged into a continuous column in suitable feed mechanism indicated generally as 50.

The membrane strip 20 is simply extended flat over the first or upper surfaces of the flanges 14.

As shown in FIG. 8B the membrane 20 is then pressed down on flanges 14 and, as shown by the two arrows, the edge portions 22 are folded around the flanges 14.

As shown in FIG. 8C the two folded portions 22 are then folded up underneath the under or second surfaces of the flanges 14 and bonded thereto.

The portions 26 or 34 are subjected to a squeezing or pinching action between adjacent Tee-nut flanges so as to form double thickness laminates.

Essentially the same operations would be carried out for the embodiment of FIGS. 4, 5 and 6.

Figure 9:
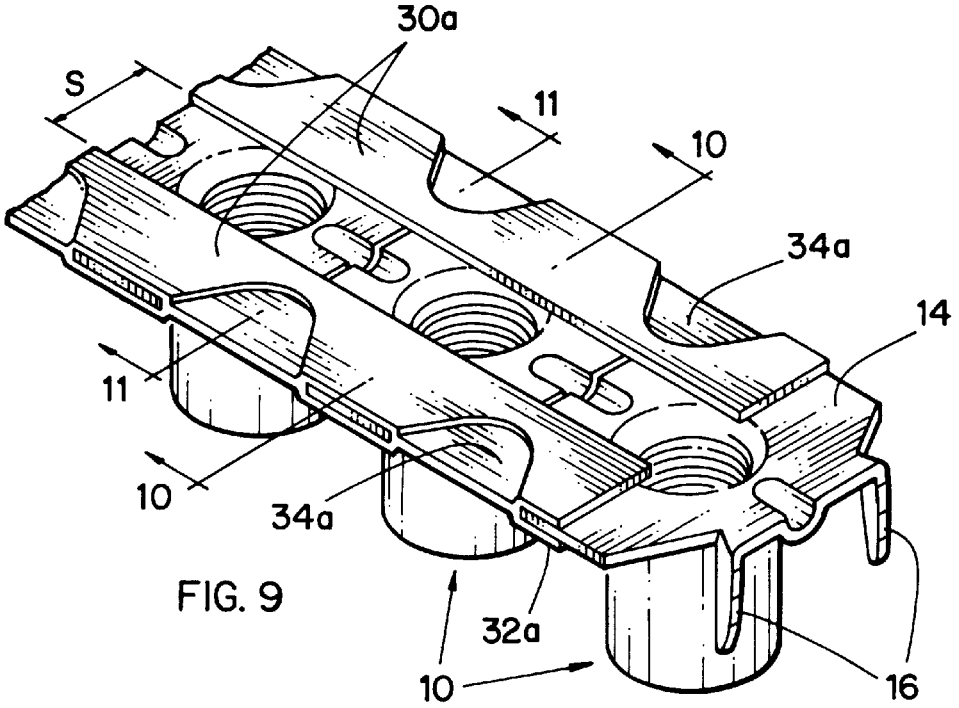
FIG. 9 is a perspective illustration of a further embodiment of the Tee-nut strip according to the invention.
Figure 10:
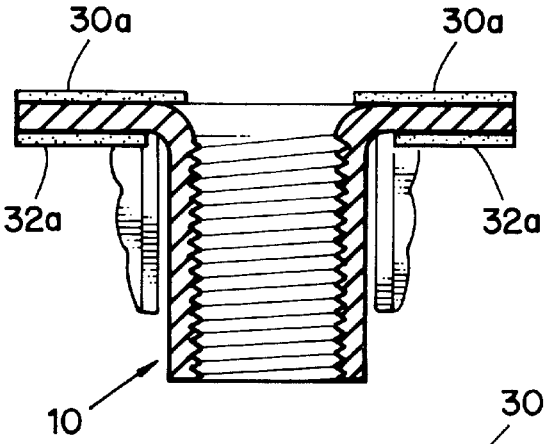
FIG. 10 is a section along the line 10—10 of FIG. 9.
Figure 11:
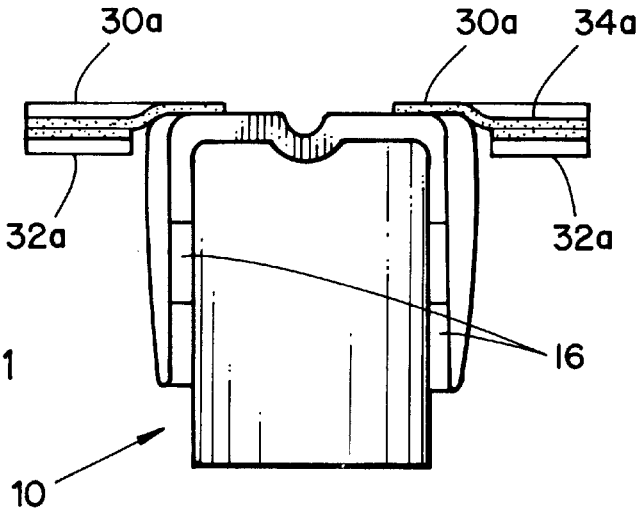
FIG. 11 is a section along the line 11—11 of FIG. 9.

As illustrated in FIGS. 9, 10 and 11, in another embodiment of the invention, the membrane means may comprise separate upper and under membrane strips indicated as 30A and 32A. The upper and under strips are separate from one another, and are simply bonded to the upper and under sides of the Tee-nut flanges, without the requirement for folding over the edges.

As illustrated in FIG. 11, between adjacent Tee-nuts, the two membranes 30A and 32A will be squeezed and laminated together.

It will also be appreciated that in some cases, as suggested above, the membrane means may be in the form of continuously extruded thermo-plastic material, which is extruded hot directly onto the upper and under surfaces of the Tee-nut flanges. Again, typically this material would be squeezed together to form a double thickness laminate in the gaps between the Tee-nut flanges as shown above.

In other cases, it may be possible to use a combination of extrusion of thermo-plastic, with a web membrane material. This is illustrated specifically in FIGS. 12A, 12B and 12C. In this case, extruder nozzles 60—60 would be positioned above the Tee-nut flanges 14 on the rails 50. They would extrude continuous strips of hot thermoplastic strip material indicated as 62. This material would then be deposited on the upper surfaces of the Tee-nut flanges 14 where it would become bonded and chilled.

Figure 12A:
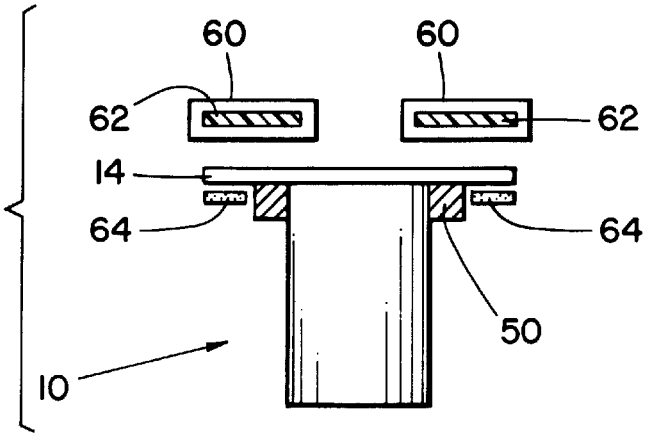
FIGS. 12A, 12B and 12C, are schematic illustrations corresponding to FIGS. 8A, 8B and 8C, showing the step wise formation of Tee-nut strips in accordance with further embodiments of the invention.
Figure 12B:
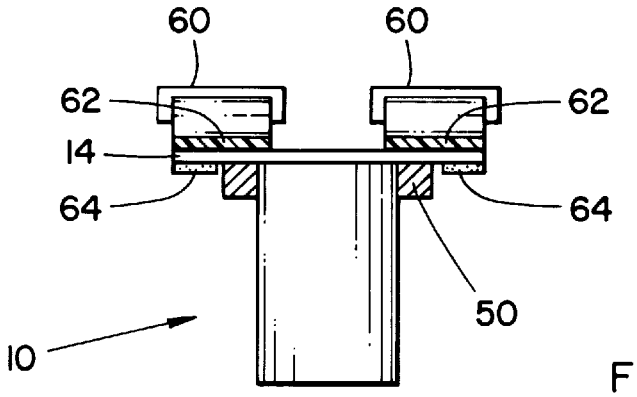
Figure 12C:
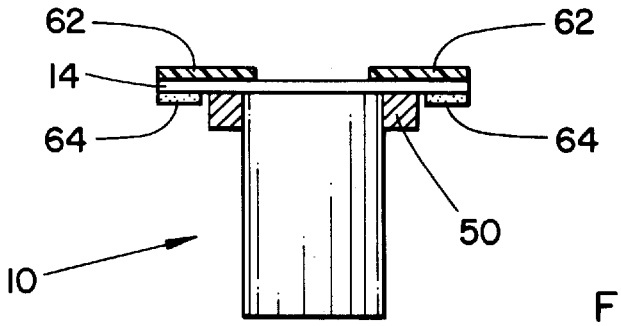

A similar extrusion operation could be carried out underneath the flanges. On the other hand, as illustrated in FIGS. 12A, 12B and 12C, continuous web material indicated as 64—64 may be bonded to the undersides of the flanges. In either case, the membrane means between the Tee-nut flanges will be squeezed together to form a double thickness laminate, in the same manner as shown above.

Figure 13:
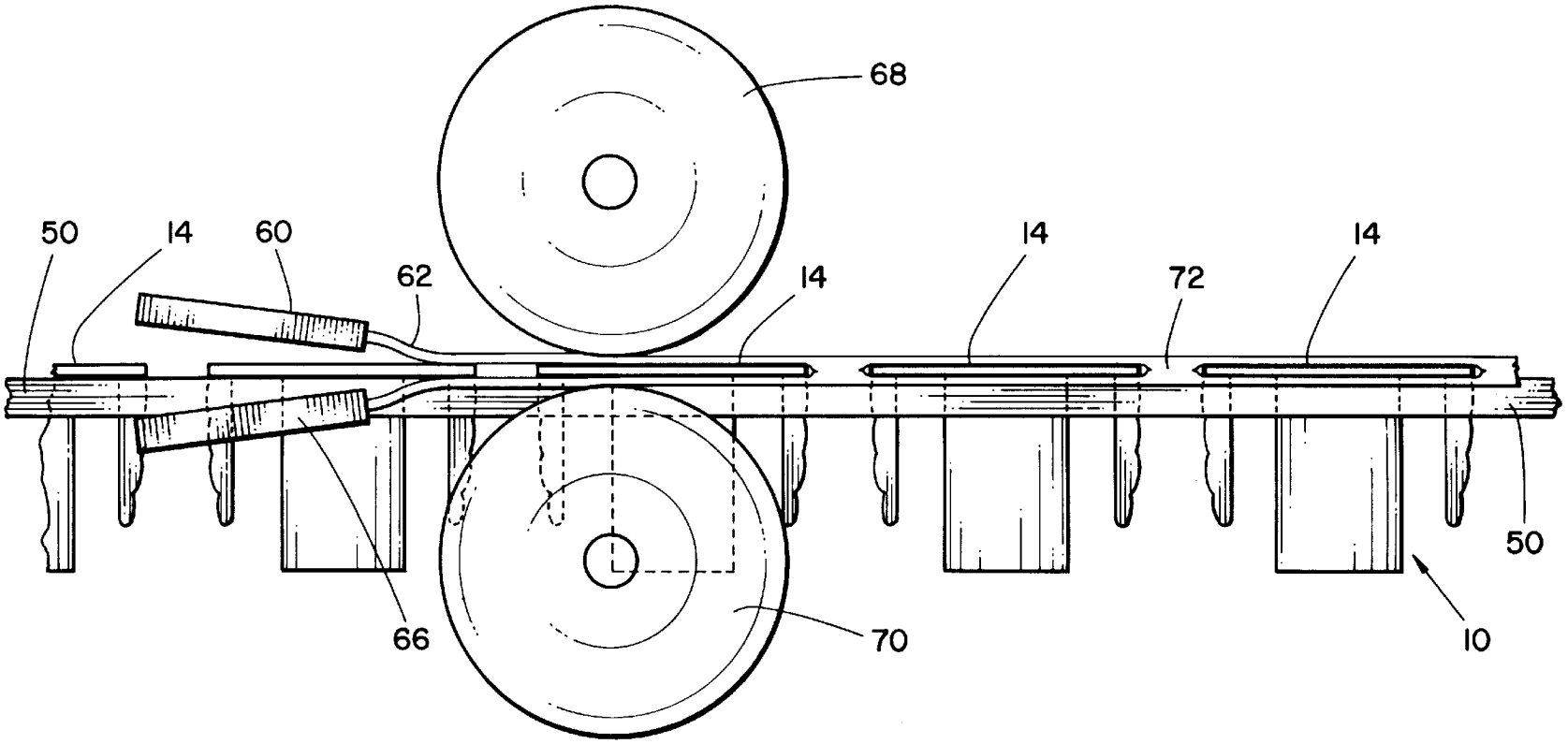
FIG. 13 is a schematic side elevation of a strip forming production line, showing extrusion of thermo plastic material on both upper and under sides of said fasteners.

As shown in FIG. 13, the double extrusion operation described above is illustrated in side-elevational schematic form. The rails 50 carry the Tee-nut flanges 14.

Upper extruder nozzles 60 would be positioned as shown in FIG. 12, and under extruder nozzles 66 would be located beneath the Tee-nut flanges. The extruder nozzles are located preferably close to the Tee-nut flanges, and once the line starts to operate, the strip material will extrude continuously, simultaneously from the nozzles 60 and 66 onto the upper and under sides of the Tee-nut flanges.

Preferably, rollers 68 and 70 are provided above and beneath the extruded thermoplastic, so as to squeeze it firmly together against the upper and under sides of the Tee-nuts respectively, and at the same time, squeeze the upper and under strips of thermo plastic material 72 together between the flanges in the manner described above.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A fastener strip in which fasteners are of the type having a threaded sleeve, and flanges formed around the sleeve, extending a pre-determined width, and comprising;

membrane means formed of flexible material;

means bonding said membrane means to first sides of said flanges on said fasteners, with said fasteners in sequential closely spaced relation along said membrane means, and;

portions of membrane means being bonded to second sides of said flanges, whereby said membrane means grips said flanges on both first and second side surfaces simultaneously.

2. A fastener strip as claimed in claim 1 wherein portions of said edge portions of said membrane means are folded around said flanges, and said membrane means between said fasteners being bonded directly to one another to form a double thickness laminate.

3. A fastener strip as claimed in claim 1 wherein said membrane means comprises two membrane portions extending between said fastener, with portions of said membrane means being bonded directly to one another between said fasteners to form a double thickness laminate.

4. A fastener strip as claimed in claim 1 wherein said membrane means comprises thermoplastic strip materials the membrane means being breakable between adjacent fasteners as they are inserted into a workpiece.

5. A fastener strip as claimed in claim 1 wherein the membrane means is sufficiently flexible that the fastener strip can be rolled into a coil.

6. A fastener strip as claimed in claim 1 wherein said membrane means comprises, at least portions of extruded thermo-plastic material, bonded directly by thermo-plastic adhesion to a surface of said fasteners in said strip.

7. A fastener strip as claimed in claim 6 wherein said membrane means comprises extruded thermo-plastic material as aforesaid on a first surface of said flanges, and web membrane means adhesively bonded to a second surface of said flanges, and said thermo-plastic material and said web membrane means being bonded together into a laminate between adjacent flanges of said fasteners.

8. A Tee-nut fastener strip in which Tee-nut fasteners are of the type having a generally cylindrical internally threaded sleeve, and flanges formed around one end of the sleeve, extending a pre-determined width, and comprising;

membrane means formed of flexible material;

means bonding first portions of said membrane means to first sides of said flanges on said fasteners, with said fasteners in sequential closely spaced relation along said membrane means; and second portions of said membrane means being bonded to second sides of said flanges, whereby said membrane means grips said flanges on both first and second side surfaces simultaneously.

9. A Tee-nut fastener strip as claimed in claim 8 wherein portions of said membrane means extending between said Tee-nuts are bonded directly to one another to form a laminate.

10. A Tee-nut fastener strip as claimed in claim 8 wherein said membrane means comprises two upper membrane portions extending between said fasteners, and two lower membrane portions, said upper and lower membrane portions being bonded directly to each other between said Tee-nuts to form a double thickness laminate.

11. A Tee-nut fastener strip as claimed in claim 8 wherein said membrane means comprises thermoplastic strip materials the membrane means being breakable between adjacent fasteners as they are inserted into the workpiece.

12. A Tee-nut fastener strip as claimed in claim 8 wherein the membrane means is sufficiently flexible that the Tee-nut strip can be rolled into a coil.

13. A Tee-nut strip as claimed in claim 8 wherein said membrane means comprises, at least portions of extruded thermo-plastic material, bonded directly by thermo-plastic adhesion to said fasteners in said strip.

14. A Tee-nut strip as claimed in claim 13 wherein said membrane means comprises extruded thermo-plastic material as aforesaid on a first surface of said flanges, and web membrane means adhesively bonded to a second surface of said flanges, and said thermo-plastic material and said web membrane means being bonded together into a laminate between adjacent flanges of said fasteners.

15. A method of forming fasteners into a fastener strip using membrane means comprising the steps of;

bonding membrane means to upper portions of said fasteners;

bonding membrane means to under portions of said fastener, and, indenting the membrane means between adjacent fasteners whereby to bond the membrane means portions together to form a double thickness laminate.

16. A method as claimed in claim 15, and further including the steps of bonding first membrane means portions to upper portions of said fasteners, and bonding second membrane means portions to said under portions of said fasteners.

17. A method as claimed in claim 15, and wherein said membrane means comprises at least one continuous strip of a web material, portions of said strip being bonded to upper portions of said fasteners and further portions of said strip being bonded to under portions of said fasteners.

18. A method as claimed in claim 17 wherein said web material comprises a continuous web having a predetermined width greater than the width of said upper and under portions of said fasteners, and wherein edge portions of said web material are folded around said upper and under portions.

19. A method as claimed in claim 15 and wherein said membrane means comprises first and second web strips, said first and second web strips being bonded to said upper portions of said fasteners in spaced apart relation, and edge portions of said web strips being folded around said fasteners and bonding to said under portions.

20. A method as claimed in claim 15 and wherein said membrane means comprises first upper portions spaced apart on opposite sides of said fasteners, and defining a spacing therebetween, and further defines second membrane strips bonded to said under portions of said fasteners.

21. A method as claimed in claim 15 and wherein said membrane means comprises at least in part, continuous, extruded thermo-plastic material, extruded directly onto said fasteners, and bonding by thermo-plastic adhesion directly to said fasteners.

* * * * *